United States Patent [19]

Pochmarski et al.

[11] Patent Number: 4,699,205

[45] Date of Patent: Oct. 13, 1987

[54] METHOD OF ESTABLISHING A TURBULENT MOTION OF MOLTEN STEEL WITHIN A STRAND GUIDE

[75] Inventors: Luzian Pochmarski; Wolfgang Polanschütz, both of Leoben, Austria

[73] Assignee: Voest-Alpine Aktiengesellschaft, Linz, Austria

[21] Appl. No.: 918,687

[22] Filed: Oct. 14, 1986

[30] Foreign Application Priority Data

Apr. 6, 1984 [AT] Austria ..... 1182/84

[51] Int. Cl.[4] ..... B22D 27/02

[52] U.S. Cl. ..... 164/468; 164/504

[58] Field of Search ..... 164/468, 504, 502, 466, 164/498, 499, 147.1

[56] References Cited

FOREIGN PATENT DOCUMENTS 28761 5/1981 European Pat. Off. ..... 164/468

10041 4/1983 European Pat. Off. .

54-37086 11/1979 Japan ..... 164/504

*Primary Examiner*—Kuang Y. Lin

*Attorney, Agent, or Firm*—Collard, Roe & Galgano

[57] ABSTRACT

A method of establishing a turbulent motion of molten steel within a strand guide of a continuous casting plant for casting a steel strand, wherein at least one group of three electromagnetic induction coils are arranged adjacent the strand guide, two of the induction elements being arranged consecutively in the longitudinal direction of the guide. At least two of the induction elements are offset relative to each other, transverse to the longitudinal direction of the strand guide, and the three induction elements form the corner points of an imaginary triangle having no more than one side lying in a plane extending parallel or perpendicular to the longitudinal direction of the strand guide. The imaginary triangle extends across the width of the strand. One phase of a three phase AC current is connected to each electromagnetic induction element. One of the induction elements has its input terminals electrically reversed with respect to the other two elements. When power is applied to the induction elements, a discontinuous electromagnetic AC field is established within the imaginary triangle extending across the width of the strand, wherein the electromotive forces produced by the induction elements produce travelling waves in several directions to cause a turbulent motion and an effective mingling of the melt within the strand over the total width of its liquid core.

2 Claims, 4 Drawing Figures

METHOD OF ESTABLISHING A TURBULENT MOTION OF MOLTEN STEEL WITHIN A STRAND GUIDE

REFERENCE TO RELATED APPLICATIONS

This is a continuation application of application Ser. No. 715,925, filed Mar. 25, 1985, for "AGITATION ASSEMBLY PROVIDED AT A STRAND GUIDE OF A CONTINUOUS CASTING PLANT", now abandoned.

The invention relates to an agitation assembly provided at a continuous casting plant, in particular a continuous casting plant for steel, comprising at least three electromagnetic induction elements arranged at a strand guide and operated with a three-phase alternating current, wherein each induction element is connected to a separate phase of the three-phase A.C. and the phases are shifted relative to one another by a phase angle of $0° < \phi \leqq 180°$, and wherein at least two induction elements are arranged consecutively in the longitudinal direction of the strand guide and at least two induction elements are offset relative to each other transverse to the longitudinal direction of the strand guide.

An arrangement of this type is known, for instance, from European patent No. 0,010,041. In order to improve the internal structure of the strand, several induction elements arranged consecutively along an axis are provided with the known agitation arrangement, which induction elements are connected in a manner that, when supplied with multi-phase A.C., a traveling wave will be generated, which extends parallel to the axis along which the induction elements are arranged.

In order to achieve a sufficient volume of the flow field within the molten portion of the strand, the known arrangement so that installation into the strand guide is impeded. Furthermore, the utilization of such an arrangement with an optimum efficiency is possible only in a certain region of the strand width such that, with different cross sectional shapes of the strand, different embodiments of the known arrangement must be applied. Finally, it is disadvantageous that, on account of the main direction of the flow of the melt being parallel to the longitudinal direction of the strand guide, an intensified mingling of melt regions having different solidification phases occurs, which, for instance, in the case of steel, promotes the formation of a "white band" in the part of the strand skin that has solidified under agitating action, which is a zone poor in segregating elements.

From European patent No. 0,010,041 it is also known to produce a traveling wave that extends obliquely to the longitudinal direction of the strand guide and which is provided for by the slanted position of an agitator assembly. There, the induction elements are arranged in the longitudinal direction of the strand guide and transverse to the same, yet the induction elements are located on a straight line such that a traveling wave is created that extends parallel to the direction of this straight line, the main direction of the flow of the melt being directed parallel to the registering induction elements. The the formation of a "white band" cannot be effectively avoided with this arrangement. Hence follows the additional disadvantage that the slanted position of the agitation assembly requires an increased structural width of the same, which, in practice, is only difficult to realize in the secondary cooling zone of a continuous casting plant, in which relatively closely neighboring support rollers for the strand are required. Such a slanted disposition is not feasible, in particular, with continuous casters for casting strands having the cross sectional shapes of a slab.

The invention aims at avoiding these disadvantages and difficulties and has as its object to provide an agitation assembly of the initially described kind, by which traveling waves are produced in several directions such that a turbulent motion, i.e., an effective mingling, of the melt within the strand is brought about over the total width of the liquid core of the strand, with the limited space conditions prevailing in the secondary cooling zone of a continuous casting plant being taken into account.

This object is achieved according to the invention with three spacially neighboring induction elements respectively arranged in the corner points of an imaginary triangle of which maximally one side lines-in a plane extending parallel perpendicularly to the longitudinal direction of the strand guide.

By the assembly according to the invention, a carrying force is created within the melt, which comprises, in addition to a longitudinal component having two degrees of freedom, at least one transverse component having two degrees of freedom. This carrying force results in a flow with the respective directional portions. Since flows within liquids fulfill the condition for continuity, closed flow fields will form that contain all the direction components in space.

By the assembly according to the invention, it is possible to agitate the core over its total width without it being required that the agitation assembly extends over the total strand width at a certain location of the strand guide. The agitation assembly according to the invention, therefore, requires little space and, thus, may be arranged even in the secondary cooling zone of a continuous casting plant for casting a strand having the cross sectional shape of a slab, without calling for any special measures (e.g., accommodation within the interior of strand guiding rollers).

Preferably, a multiple of three induction elements are provided, the circuitry of the individual induction elements being so arranged that those induction elements cooperate which are arranged in the longitudinal direction of the strand guide and offset relative to one another transverse to this longitudinal direction, i.e., which are located on the corner points of the triangle.

Suitably, the arrangement of the induction elements offset transverse to the longitudinal direction of the strand guide is effected in a manner that at least one of the induction elements is provided on the front face of the strand and at least one induction element is provided on the rear face of the strand.

If strands having different cross sectional formats, in particular, different widths, are cast in a continuous casting plant, at least one induction element advantageously is adjustable in the direction transverse to the longitudinal axis of the strand guide, whereby the agitation of the liquid core over its total width is feasible with one and the same agitation assembly even with different strand cross sectional formats.

In a particularly preferred embodiment, electromotoric forces whose instantaneous value differences and direction differences correspond to a phase angle difference of $\phi + 180°$ are produced in at least two neighboring induction elements. By the combination of the particular spacial arrangement of the induction elements in the form of a triangle and by the generation of a discontinuous magnetic A.C. field, not only multidirectional traveling waves but also, opposite directed traveling waves are created, so that, in addition to a turbulent motion, also a mingling of the melt, caused by electromagnetically enforced oscillations, are provided. The strands that are agitated by means of this preferred agitation assembly stand out for their particularly uniform structures.

The invention will now be explained in more detail by way of several embodiments with reference to the accompanying drawings, wherein:

DETAILED DESCRIPTION OF THE DRAWINGS

Figure 1:
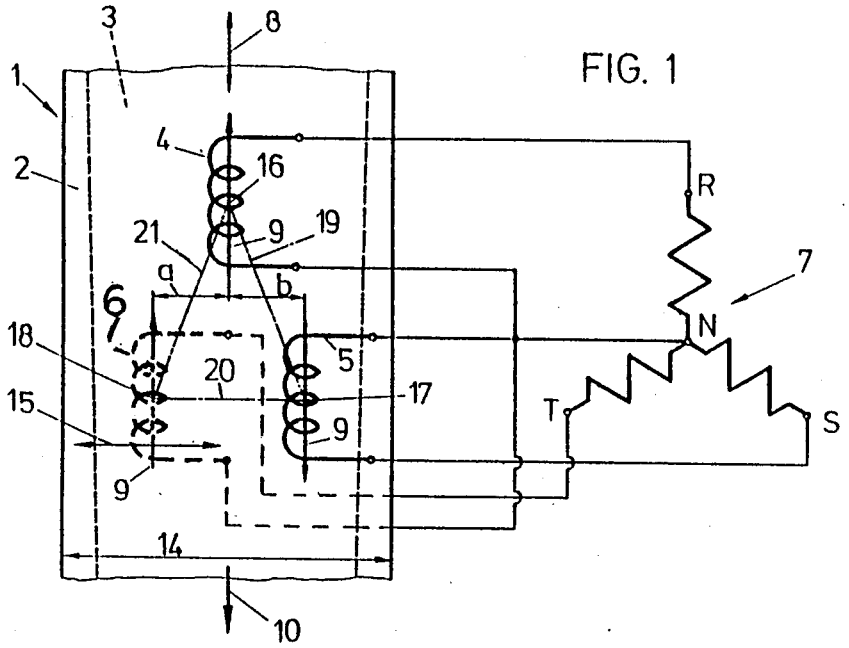
FIG. 1 is a schematic side view showing three induction elements provided in the strand guide of a strand of a continuous casting device connected in a three-phase Y-connection system according to the invention.

According to FIG. 1, three induction elements are provided in the strand guide of a strand 1 continuously cast in a continuous caster. The skin of the strand is denoted by 2 and its liquid core is denoted by 3. The induction elements are designed as coils 4, 5, 6, if desired, equipped with cores or yokes.

The induction elements 4, 5, 6 are fed from a three-phase rotary power supply 7, whose phases or conductors R, S, T are connected in a Y-connection.

According to the invention, the induction elements 5, 6 are arranged behind the induction element 4 in the longitudinal direction 8 of the strand guide and are offset with respect to the induction element 4 transverse to the longitudinal direction 8, by the distances a, b. As is apparent from FIG. 1, the offset arrangement has been so chosen that the field vectors 9 are laterally offset relative to one another and are parallel.

The connection to the rotary current network 7 is effected in the following manner:

The end of induction element 4 and of the induction element 6 that is closer to the mold (not illustrated) is connected to the R- and T-conductors, whereas the end of the induction element 5 that is closer to the mold is connected to the central conductor N. The two ends of the induction elements 4 and 6 that are remote from the mold in the extraction direction 10 of the strand are connected to the central conductor N and the end of the induction element 5, that is remote from the mold in the extraction direction 10 is connected to the S-conductor. On account of the middle induction element 5 being connected in opposition in this way, a discontinuous electromagnetic A.C. field is formed, which prevents the expansion of a uni-directional flow of the metal melt in the liquid core 3 of the strand 1. The phase shift of the three rotary current phases R, S, T amounts to 120°, as usual.

Figure 2:
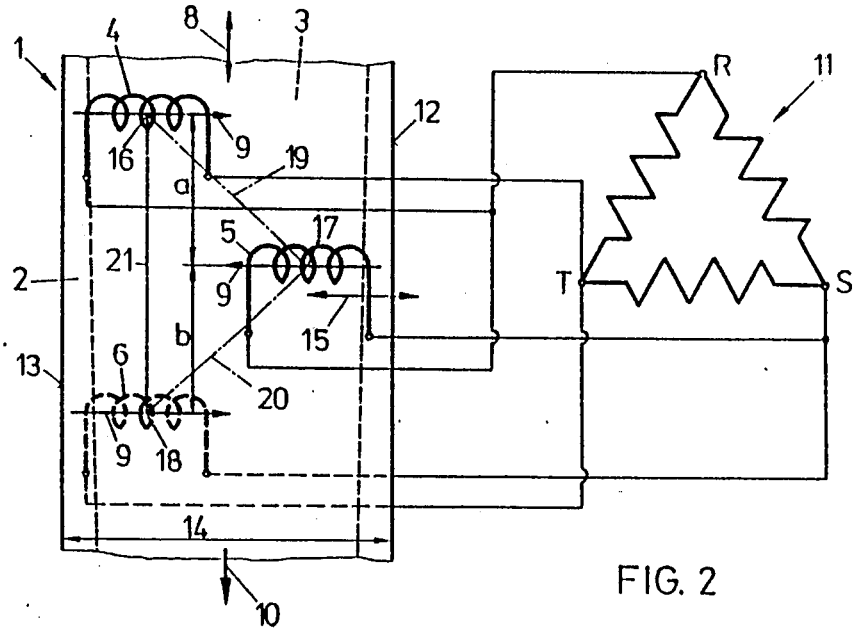
FIG. 2 is a schematic side view showing three induction elements provided in the strand guide of a strand of a continuous casting device connected in a three-phase delta connection system according to the invention.

According to the embodiment illustrated in FIG. 2, the induction elements 4 to 6 are connected to a three-phase network 11 arranged in a delta connection system, wherein, in contrast to the embodiment illustrated in FIG. 1, the induction elements are disposed with their axes not parallel to the longitudinal direction 8 of the strand guide, but transverse thereto, i.e., parallel to the surface of the strand 1 forming the wide side. Also in this case, the induction element 5 is connected in opposition to the two other induction elements 4 and 6, so that, again, no traveling wave continuously propagating over the three induction elements can form, but a discontinuous electromagnetic alternating wave is created.

The offset arrangement of the induction elements 4, 5, 6 transverse to the longitudinal direction 8 of the strand guide is realized in a manner that the induction elements 4, 5 are located in front of the strand and the induction element 6 is located behind the strand, the induction element 6 thus being not visible in the top view illustrated in FIG. 2. In addition, the induction element 5 has been arranged to to the narrow side 12 of the strand, whereas the two induction elements 4 and 6 are located in the vicinity of the opposite narrow side 13. The frequency of the alternating current of the embodiment illustrated in FIGS. 1 and 2 suitably amounts to between 2 and 120 Hz.

For adaptation to different strand widths 14, at least one of the induction elements advantageously is arranged to be displaceable at the strand guide transverse to the longitudinal direction 8 of the strand guide, in the direction of the double arrow 15.

It is essential to this invention that, with an arrangement of three induction elements, these induction elements are located in the corner points 16, 17, 18 of an imaginary triangle, in other words, that the induction elements are not in alignment so that the electromotoric forces produced by the induction elements do not act in a common single direction. The gravity centers of the induction elements may be taken as the corner points of the imaginary triangle.

Of the sides 19, 20, 21 of this imaginary triangle, maximally one side is located in a plane extending parallel (according to FIG. 2, side 21) or transverse (according to FIG. 1, side 20) to the longitudinal direction 8 of the strand guide.

Figure 3:
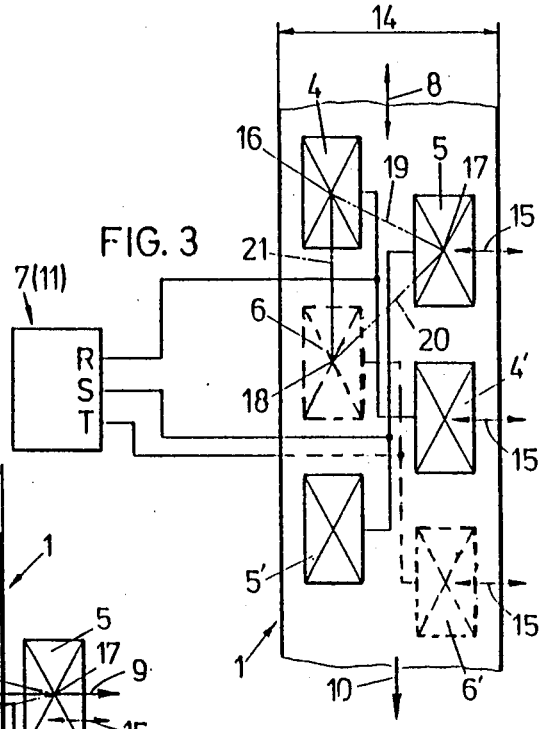
FIG. 3 is a schematic side view showing six induction elements provided in the strand guide of a strand of a continuous casting device according to the invention.
Figure 4:
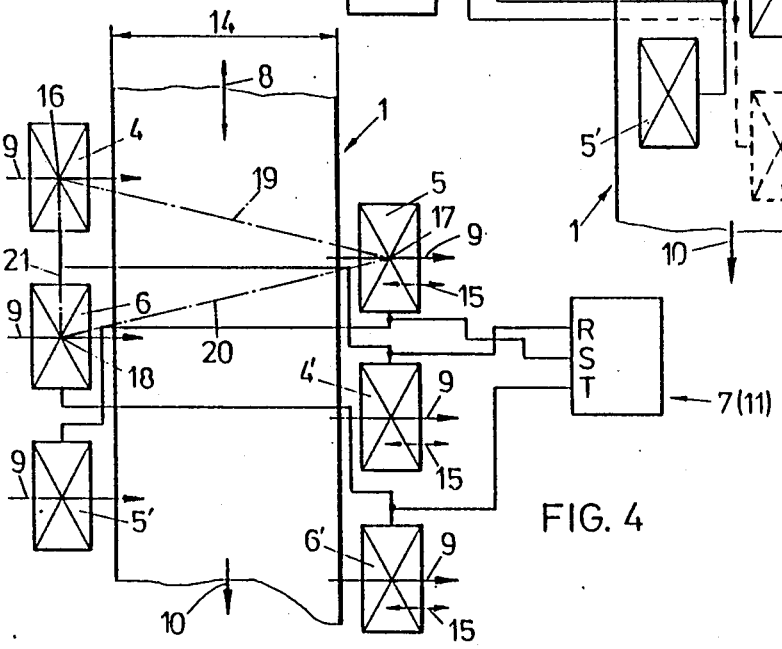
FIG. 4 is a schematic side view showing six induction elements distributed on opposite sides of the strand of a continuous casting device according to the invention.

FIGS. 3 and 4 show embodiments comprising six induction elements 4, 4', 5, 5', 6, 6', three 4, 5, 6 and 4', 5', 6' of which are each connected as illustrated in FIGS. 1 or 2.

It is essential for the agitation assemblies illustrated in FIGS. 3 and 4 that three induction elements belonging together are each located in the corner points of an imaginary triangle such that the electromotoric forces caused thereby do not act in a common single direction, either. In this case, too, maximally one side 21 is directed parallel or transverse to the longitudinal direction 8 of the strand guide. The induction elements 4 to 6' of the agitation assemblies illustrated in FIGS. 3 and 4 comprise field vectors 9 that are directed perpendicular to the strand surface.

According to the embodiments illustrated in FIGS. 3 and 4, suitably one of the two neighboring rows of induction elements is adjustable transverse to the longitudinal direction 8 of the strand guide.

On account of the relative movement of the metal melt to the strand skin, the dendrites forming at the solidification front are broken and introduced into the liquid portion of the strand. A discontinuous concentration variation in the thin layer at the transition between the liquid and the solid states of aggregation, with the agitation assembly according to the invention, can take place not at all or only to a slight measure, so that the formation of a white band will not occur or only to a slight, negligible extent.

The favorable effects of electromagnetic action on the solidification of continuous castings, thus, can be fully utilized without having to put up with the disadvantages so far faced in practice.

In particular, it is possible to install the agitation assembly according to the invention at a strand guide even with narrow spacial conditions.

What is claimed is:

1. A method of establishing a turbulent motion of molten steel within a strand guide of a continuous casting plant for casting a strand, such as a steel strand, comprising the steps of:

arranging at least one group of three electromagnetic induction coils adjacent the strand guide, wherein at least two of said induction elements are arranged consecutively in the longitudinal direction of said strand guide and at least two of said induction elements are offset relative to each other transverse to the longitudinal direction of said strand guide, and wherein the three induction elements are arranged so as to constitute the corner points of an imaginary triangle having no more than one side lying in a plane extending parallel or perpendicularly to the longitudinal direction of said strand guide, the imaginary triangle extending across the width of the strand; and connecting a three phase alternating current to said electromagnetic induction elements wherein each of said induction elements is connected to a separate one of said three phases, and wherein at least one of said induction elements has its input terminals electrically reversed with respect to the other two of said elements, so that upon the application of electrical power to the induction elements, a discontinuous electromagnetic a/c field is established within the imaginary triangle extending across the width of the strand, so that the induction elements are not in allignment, and the electromotive forces produced by the induction elements do not act in a common single direction, the coils producing travelling waves in several directions, so that a turbulent motion and an effective mingling of the melt within the strand occurs over the total width of the liquid core of the strand.

2. The method as recited in claim 1, additionally comprising the step of displacing at least one of said induction elements with respect to the strand guide transverse to the longitudinal direction of the guide.

* * * * *